US007637043B2

(12) United States Patent
Brown, Jr. et al.

(10) Patent No.: US 7,637,043 B2
(45) Date of Patent: Dec. 29, 2009

(54) MOTORIZED PHOTO DISPLAY

(76) Inventors: Jimmie R. Brown, Jr., 1475 79th Ave., Oakland, CA (US) 94621; Wilford Armstrong, III, 1475 79th Ave., Oakland, CA (US) 94621

( * ) Notice: Subject to any disclaimer, the term of this patent is extended or adjusted under 35 U.S.C. 154(b) by 142 days.

(21) Appl. No.: 12/075,178

(22) Filed: Mar. 11, 2008

(65) Prior Publication Data

US 2009/0229151 A1 Sep. 17, 2009

(51) Int. Cl.
*G09F 11/02* (2006.01)

(52) U.S. Cl. ..... 40/475; 40/531

(58) Field of Classification Search ..... 40/533, 40/500, 530, 531, 377, 493, 475; 84/487; 368/235; 248/441.1, 473, 309.2
See application file for complete search history.

(56) References Cited

U.S. PATENT DOCUMENTS

| | | | | |
|---|---|---|---|---|
| 447,815 | A | 3/1891 | Frercks | |
| 1,218,082 | A | 3/1917 | Hall | |
| 1,543,605 | A | 6/1925 | Gavard | |
| 1,566,860 | A | 12/1925 | Hainzigianis | |
| 1,813,442 | A * | 7/1931 | Dobrowsky | 40/500 |
| 1,905,239 | A | 4/1933 | McDonald | |
| 2,252,794 | A | 8/1941 | Welch | 40/35 |
| D199,291 | S | 9/1964 | Jahn | D80/9 |
| 3,217,435 | A | 11/1965 | Steiert | 40/35 |
| 3,585,746 | A | 6/1971 | Sterler | 40/35 |
| D227,190 | S | 6/1973 | McKinsey | D87/1 D |
| 4,021,947 | A | 5/1977 | Shneider | 40/68.6 |
| 4,215,511 | A * | 8/1980 | Todokoro | 446/408 |
| D281,336 | S | 11/1985 | Ahlgren | D20/21 |
| 4,599,815 | A | 7/1986 | Waldo | 40/377 |
| D292,781 | S | 11/1987 | Shane | D11/132 |
| 5,076,444 | A | 12/1991 | Syms | 211/69.5 |
| 5,176,264 | A | 1/1993 | De Palma | 211/40 |
| 5,289,651 | A | 3/1994 | Byers | 40/533 |
| 5,493,803 | A | 2/1996 | Byers | 40/533 |
| D457,004 | S | 5/2002 | Brown, Jr. | D6/301 |
| 6,893,317 | B1 * | 5/2005 | Vlodek | 446/147 |

* cited by examiner

*Primary Examiner*—Joanne Silbermann
(74) *Attorney, Agent, or Firm*—Donald R. Schoonover

(57) ABSTRACT

A motorized photo display having a base; a frame including a bottom portion mounted on the base, a wall portion including first and second wall portions mounted on the bottom portion, at least one opening having a retaining tab; a drive element having a drive shaft rotatable about a vertically-oriented drive axis and a drive mechanism; a spool mechanism mounted on the drive mechanism and having a spindle with a longitudinal axis colinear with the drive axis, opposing upper and lower pivot rings extending outwardly from upper and lower extremities of the spool mechanism and having vertically-aligned pairs of orifices; centering plates fixedly securing the upper and lower pivot rings about the spindle; a plurality of photo holders having pivot hinges mounted to corresponding pairs of the vertically-aligned orifices of the upper and lower pivot rings; and a power source.

9 Claims, 3 Drawing Sheets

MOTORIZED PHOTO DISPLAY

BACKGROUND OF THE INVENTION

1. Field of the Invention

The present invention relates to photograph displays and, more specifically without limitation, to portable motorized photograph displays.

2. Description of the Related Art

Many people currently take a multitude of photographs of almost every important event in their lives. A problem that such massive numbers of photographs create is the ability to display the photographs for others to view. At honor gatherings—such as birthday parties, graduation parties, and anniversary parties for example—it is generally overly cumbersome and impractical to display selected photographs in a stack of photo albums.

What is needed is a motorized apparatus that can mechanically, progressively, repeatedly, efficiently, and simultaneously display selected photographs to a plurality of viewers.

SUMMARY OF THE INVENTION

The improvements of the present invention for a motorized photo display include a base, a frame, a drive element, a spool mechanism, centering plates, a plurality of photo holders, a manually-controlled mechanism for overriding the drive mechanism, and a power source.

The frame includes a bottom portion mounted on the base, a wall portion mounted on the bottom portion wherein the wall portion includes a first wall portion and a second wall portion with the first and second wall portions defining at least one opening having an opening edge with a retaining tab, and a top portion mounted on the wall portion and having a vertically-oriented orifice therethrough.

The drive element is mounted on the bottom portion and includes a housing, a motor with a drive shaft rotatable about a vertically-oriented drive axis, and a drive mechanism.

The spool mechanism includes a spindle having a vertically-oriented longitudinal axis, an upper pivot ring extending outwardly from an upper extremity of the spool mechanism and having a plurality of orifices, a lower pivot ring extending outwardly from a lower extremity of the spool mechanism and having a plurality of orifices vertically-aligned with corresponding orifices of the plurality of orifices of the upper pivot ring wherein the spool mechanism is mounted on the drive mechanism with the spindle extending upwardly through the orifice of the top portion.

The centering plates fixedly secure the upper and lower pivot rings about the spindle wherein the longitudinal axis of the spindle is colinear with the drive axis.

Each of the plurality of photo holders includes a pivot hinge pivotally mounted to a corresponding pair of vertically-aligned orifices of the plurality of orifices of the upper and lower pivot rings. Each of the photo holders includies a planar transparent leading face, a planar transparent trailing face, a distal end, a biasing device, and a cavity dimensioned to receive one or more photos operably visible through the leading face and one or more photos operably visible through the trailing face.

The power source, such as a connection to an electrical circuit or an internal battery, is structured to provide electrical energy to the drive element.

As the drive element rotates the drive mechanism about the drive axis, the retaining tab successively extends into a path of the distal end of each of the photo holders of the plurality of photo holders thereby initially and sequentially obstructing displacement of the trailing faces of the plurality of photo holders into the at least one opening.

As the drive element continues to rotate the drive mechanism, each photo holder is successively obstructed from being displaced into the at least one opening until the spacing between the retaining tab and the pivot hinge of the photo holder being obstructed by the retaining tab exceeds the spacing between the pivot hinge of the photo holder being obstructed and the distal end of that photo holder.

As the distal end of the respective photo holder escapes past the retaining tab, the respective biasing device immediately biases the photo holder approximately 180° whereat both the trailing face of that photo holder and the leading face of the next successive photo holder then being obstructed by the retaining tab are simultaneously visible through the at least one opening.

PRINCIPAL OBJECTS AND ADVANTAGES OF THE INVENTION

The principal objects and advantages of the present invention include: providing a motorized photograph display that mechanically, progressively, repeatedly, efficiently, and simultaneously displays selected photographs to a plurality of viewers; and generally providing such a motorized photograph display that is reliable in performance, capable of long-lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

Figure 1:
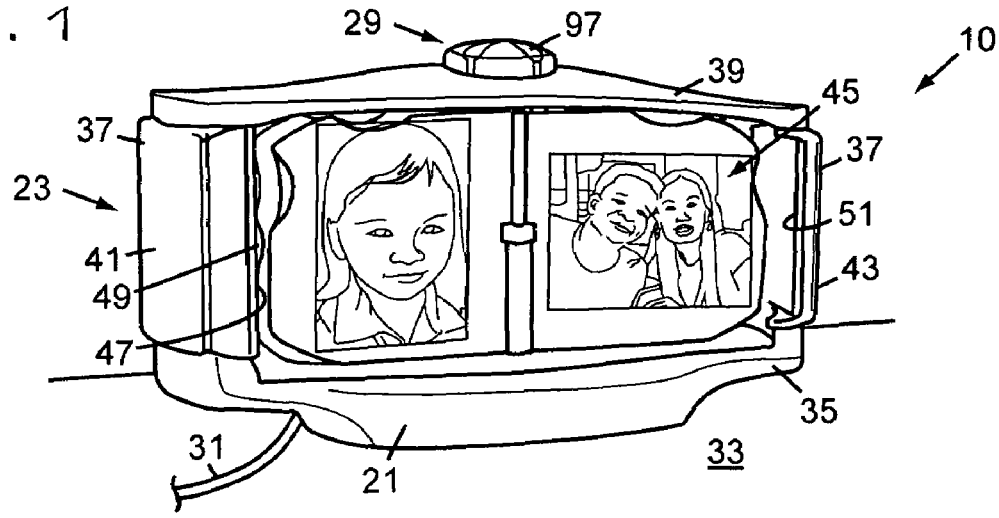
FIG. 1 is perspective view of a motorized photo display in accordance with the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The reference numeral 10 refers to a motorized photo display in accordance with the present invention, as shown in FIGS. 1 through 9. The motorized photo display 10 includes a base 21, a frame 23, a drive element 25, a spool mechanism 27, a manually-operable mechanism 29, and a power source 31.

The base 21 is structured to support the motorized photo display 10 in an upright orientation when placed on a generally planar underlying surface 33, as shown in FIG. 1.

The frame 23 includes a bottom portion 35, a wall portion 37, and a top portion 39. The bottom portion 35 is mounted on the base 21. The wall portion 37 is mounted on the bottom portion 35 and generally includes a first wall portion 41 and a second wall portion 43. The first and second wall portions 41, 43 define at least one opening 45 having a first opening edge 47 with a retaining tab 49, and a second opening edge 51. For some applications, the motorized photo display 10 may include two openings 45 spaced between the first and second wall portions 41, 43 on opposing sides of the motorized photo display 10. The top portion 39 is mounted on the wall portion 37 and includes a vertically-oriented orifice 53 therethrough.

Figure 2:
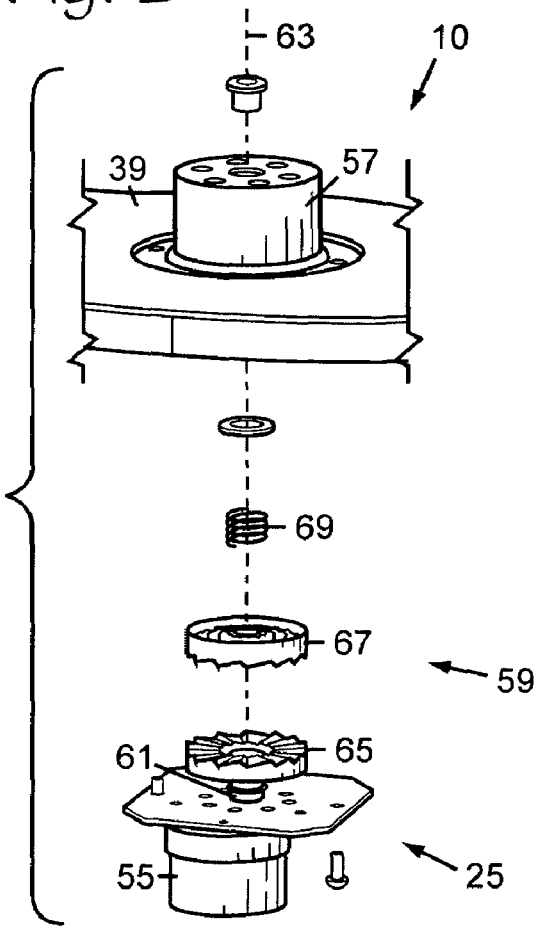
FIG. 2 is an enlarged, exploded and fragmentary, perspective view of a drive element of the motorized photo display.

The drive element 25 includes a motor 55, a housing 57, and a drive mechanism 59. The motor 55 and housing 57 are mounted on the bottom portion 35, as shown in FIG. 2, such that a drive shaft 61 of the motor 55 rotates about a vertically-oriented drive axis 63. The drive mechanism 59 includes a lower gear 65 fixedly secured to the drive shaft 61, and an upper gear 67, substantially identical to the lower gear 65, drivingly engageable with the lower gear 65.

A resilient device 69, such as a compression coil spring as shown in FIG. 2, biases the upper gear 67 against the lower gear 65 as described herein. Each tooth of the upper and lower gears 65, 67 has gently-inclining gear portions 71 and steeply-declining gear portions 73 adjacently spaced therebetween. The gear portions 71, 73 are arranged wherein the motor operably causes the steeply-declining gear portions 73 of the lower gear 65 to be forced against the steeply-declining gear portions 73 of the upper gear 67.

Figure 4:
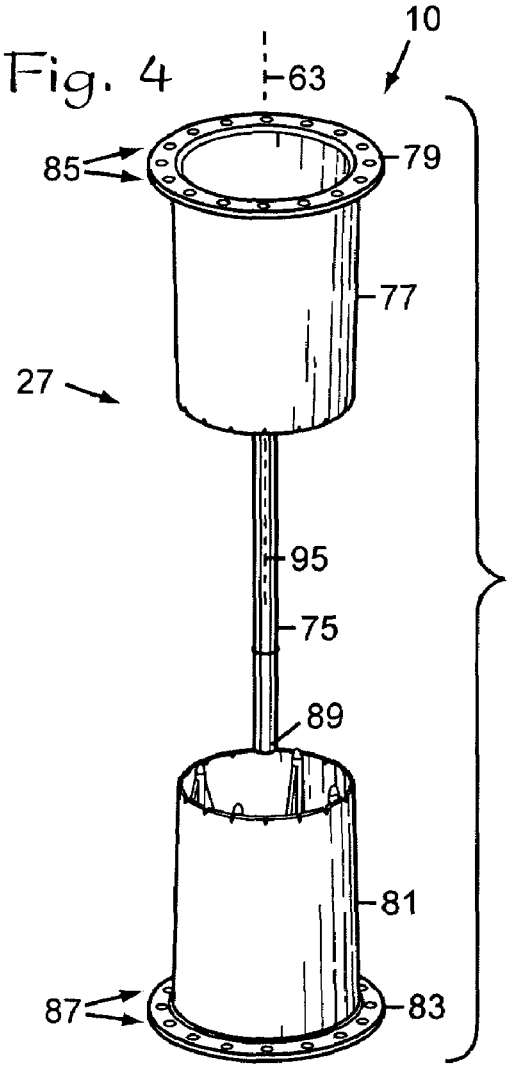
FIG. 4 is an enlarged and exploded, perspective view of upper and lower portions of a spool mechanism of the motorized photo mechanism.
Figure 3:
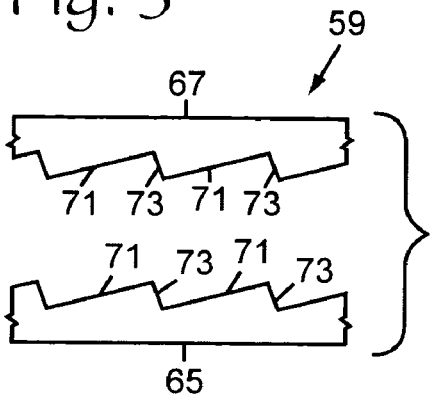
FIG. 3 is a further enlarged, fragmentary and side elevational view of upper and lower gears of a drive mechanism of the motorized photo display.
Figure 5:
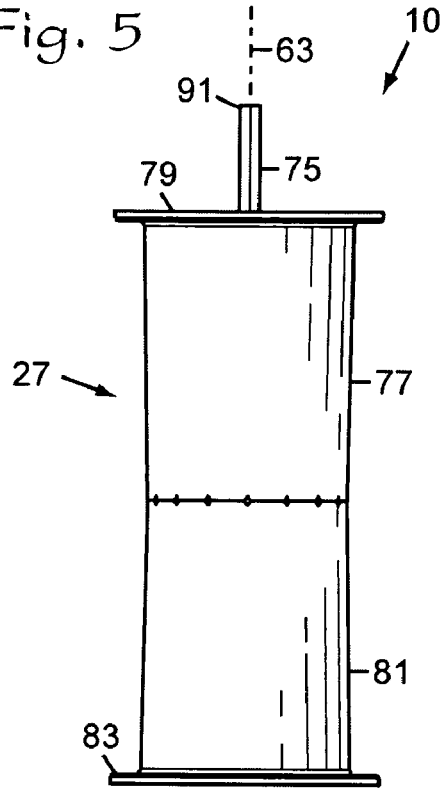
FIG. 5 is a side elevational view of the upper and lower portions of the spool mechanism of the motorized photo mechanism shown in FIG. 4.

The spool mechanism 27 includes a spindle 75, an upper spool portion 77 having an upper pivot ring 79 fixedly secured to and extending outwardly from an upper extremity thereof, and a lower spool portion 81 having a lower pivot ring 83 fixedly secured to and extending outwardly from a lower extremity thereof, as shown in FIGS. 4 and 5. The upper and lower pivot rings 79, 83 are arranged wherein each of a plurality of orifices 85 through the upper pivot ring 79 are vertically aligned with a corresponding orifice of a plurality of orifices 87 through the lower pivot ring 83.

Preferably, the plurality of orifices 85 through the upper pivot ring 79 are equidistantly-spaced apart, and the plurality of orifices 87 through the lower pivot ring 83 are also equidistantly-spaced apart. Each orifice of the plurality of orifices 85 through the upper pivot ring 79 are vertically-aligned with a respective orifice of the plurality of orifices 87 through the lower pivot ring 83. For some applications, however, it may be desirable that the time interval which certain photos are displayed may be longer or shorter that the time interval or time intervals that other photos are displayed as described herein. In that event, the spacing between corresponding vertically-aligned pairs of orifices of the plurality of orifices 85, 87 and the vertically-aligned pairs of orifices adjacent thereto may differ accordingly.

Figure 6:
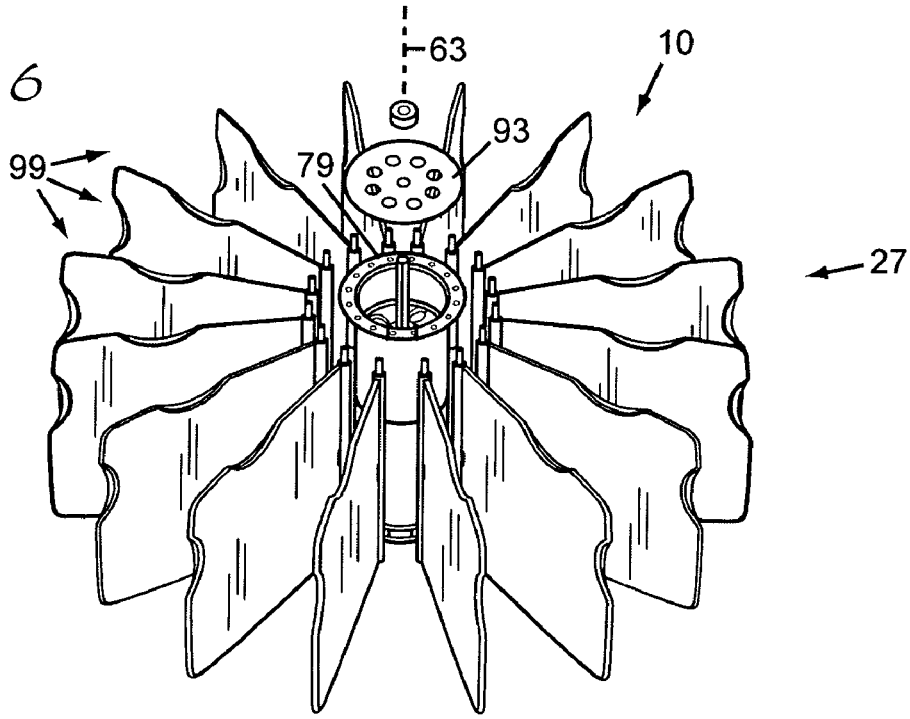
FIG. 6 is an enlarged and exploded, perspective view of a plurality of photo holders of the motorized photo mechanism.
Figure 7:
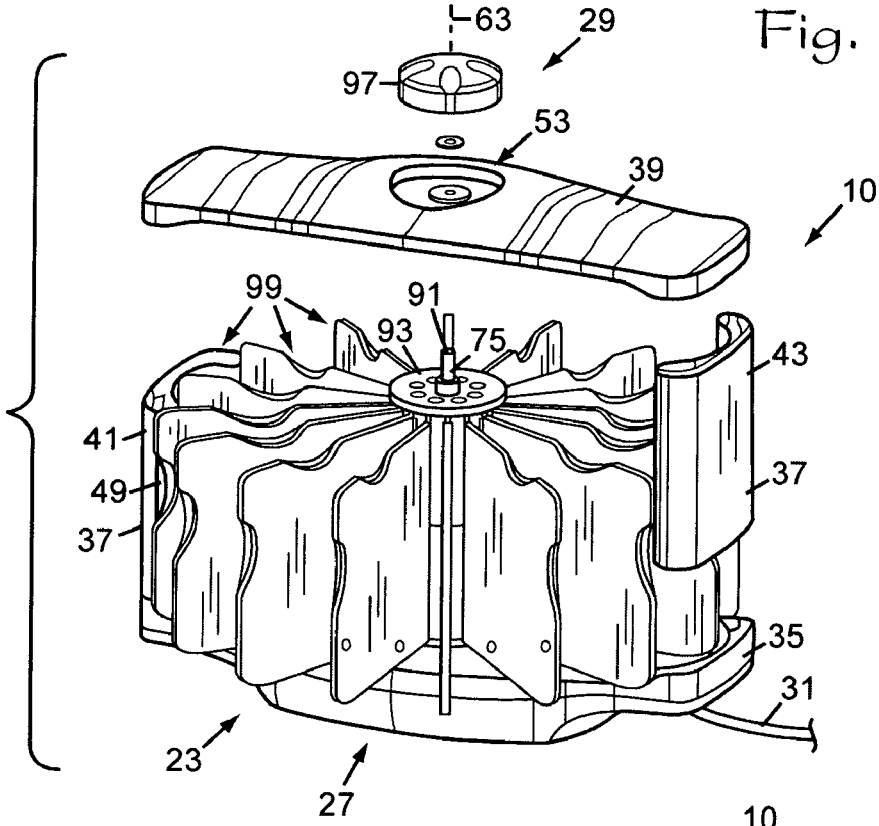
FIG. 7 is an enlarged and partially exploded view of the plurality of photo holders of the motorized photo mechanism.

A lower end 89 of the spindle 75 is fixedly secured to the upper gear 67 and an upper end 91 of the spindle 75 extends rotatably upwardly through the orifice 53 of the top portion 39. Centering plates 93 fixedly secure the upper and lower pivot rings 79, 83 about the spindle 75 such that a longitudinal axis 95 of the spindle 75 is colinear with the drive axis 63, as shown in FIGS. 6 and 7 and the plurality of orifices are equidistantly-spaced apart from the drive axis 63.

The manually-operable mechanism 29, such as a knob 97, is spaced above the top portion 39 and is fixedly secured to the upper end 91 of the spindle 75 for overriding the drive element 25 if desired.

Figure 8:
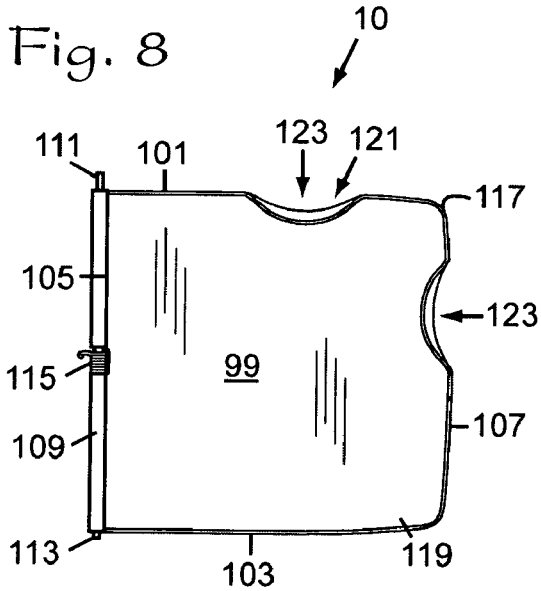
FIG. 8 is an enlarged and side elevational view of a photo holder of the motorized photo mechanism.

Each of a plurality of photo holders 99 includes an upper holder edge 101, a lower holder edge 103, a proximal end 105, a distal end 107, and a pivot hinge 109 mounted in the proximal end 105 wherein each pivot hinge 109 has an upper hinge end 111 pivotally mounted in an orifice of the plurality of orifices 85 through the upper pivot ring 79 and a lower hinge end 113 pivotally mounted in a corresponding vertically-aligned orifice of the plurality of orifices 87 through the lower pivot ring 83. A biasing device 115 is mounted, preferably centrally, on each pivot hinge 109, as shown in FIG. 8, which biases the respective photo holder 99 as described herein.

Figure 9:
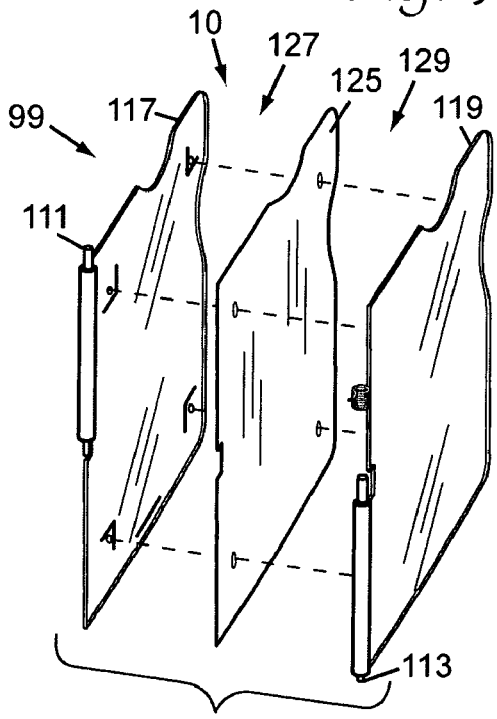
FIG. 9 is an exploded, perspective view of a photo holder of the motorized photo mechanism in accordance with the present invention.

Each of the plurality of photo holders 99 includes a planar transparent leading face 117, a planar transparent trailing face 119, and a cavity 121 dimensioned to receive one or more photos to be operably visible through the leading face 117 and/one or more photos to be operably visible through the trailing face 119 wherein the photos are insertable into the cavity 121 through a slot 123 in the upper holder edge 101 and/or the distal end 107 of the photo holder 99. If desired, each photo holder 99 may include a partition 125 which separates the cavity 121 into a leading cavity 127 spaced between the leading face 117 and the partition 125, and a trailing cavity 129 spaced between the trailing face 119 and the partition 125, as shown in FIG. 9.

The power source 31, such as a power cord connected to an electrical circuit or an internal battery, is structured to provide electrical energy to the drive element 25.

The motorized photo display 10 is structured and dimensioned wherein, as the drive element 25 rotates the lower and upper gears 65, 67 of the drive mechanism 59 about the drive axis 63, the retaining tab 49 successively extends into a path of the distal end 107 of each of the photo holders 99 of the plurality of photo holders thereby initially obstructing the displacement of the trailing face 119 of that photo holder 99 into the at least one opening 45.

As the drive element 25 continues to rotate the lower and upper gears 65, 67 about the drive axis 63, the spacing between the retaining tab 49 and the pivot hinge 109 of the photo holder 99 being obstructed by the retaining tab 49 exceeds the spacing between that pivot hinge 109 and the distal end 107 of the photo holder 99 being obstructed by the retaining tab 49.

As the distal end 107 of the photo holder 99 being obstructed by the retaining tab 49 escapes past the retaining tab 49, the biasing device 115 immediately biases the photo holder 99 approximately 180 degrees whereat the trailing face 119, instead of the leading face 117, is directed toward the at least one opening 45 such that both the trailing face 119 of that photo holder 99 and the leading face 117 of the next successive photo holder 99 then being obstructed by the retaining tab 49 are simultaneously visible through the at least one opening 45.

In an application of the present invention, photos are placed in each of the photo holders 99, one or more of those photos facing the leading face 117 of the respective photo holder 99 and one or more of those photos facing the trailing face 119 of the respective photo holder 99. After activating the motor 55, the trailing face 119 of one photo holder 99 and the leading face 117 of the following photo holder 99 are simultaneously and progressively shown through the at least one opening 45. Preferably, the at least one opening 45 includes two openings spaced on opposite sides of the wall portion 37, namely between the first and second wall portions 41, 43, so photos can be viewed simultaneously from opposing sides of the motorized photo display 10.

In the event that power is not available for operating the motorized photo display 10, or if a user desires to turn the spool mechanism 27 backward to view a previously displayed photo, the user simply grasps the knob 97 and turns it in a direction opposite to the direction that the motor 55 would turn the spool mechanism 27. In that event, the resilient device 69 allows the gently-inclining gear portions 71 of the upper gear 67 to slide over the gently-declining gear portions 71 of the lower gear 65 to thereby allow the spool mechanism 27 to be manually rotated such that previously viewed photos are redisplayed through the at least one opening 45.

It is to be understood that while certain forms of the present invention have been illustrated and described herein, it is not to be limited to the specific forms or arrangement of parts as described and shown.

The invention claimed is:

1. A motorized photo display comprising:

(a) a base;

(b) a frame including:

(1) a bottom portion mounted on the base, (2) a wall portion mounted on the bottom portion, the wall portion including a first wall portion and a second wall portion, the first and second wall portions defining at least one opening having an opening edge with a retaining tab, and (3) a top portion mounted on the wall portion and having a vertically-oriented orifice therethrough;

(c) a drive element mounted on the bottom portion, the drive element including a housing, a motor with a drive shaft rotatable about a vertically-oriented drive axis, and a drive mechanism;

(d) a spool mechanism having a spindle with a vertically-oriented longitudinal axis, an upper pivot ring extending outwardly from an upper extremity of the spool mechanism and having a plurality of orifices, a lower pivot ring extending outwardly from a lower extremity of the spool mechanism and having a plurality of orifices vertically-aligned with corresponding orifices of the plurality of orifices of the upper pivot ring, the spool mechanism being mounted on the drive mechanism with the spindle extending upwardly through the orifice of the top portion;

(e) centering plates fixedly securing the upper and lower pivot rings about the spindle wherein the longitudinal axis of the spindle is colinear with the drive axis;

(f) a plurality of photo holders, each having a pivot hinge pivotally mounted to a corresponding pair of vertically-aligned orifices of the plurality of orifices of the upper and lower pivot rings, each of the photo holders including a planar transparent leading face, a planar transparent trailing face, a distal end, a biasing device, and a cavity dimensioned to receive one or more photos to be operably visible through the leading face and one or more photos to be operably visible through the trailing face; and (g) a power source structured to provide electrical energy to the drive element; and (h) wherein, (1) as the drive element rotates the drive mechanism about the drive axis, the retaining tab successively extends into a path of the distal end of each of the photo holders of the plurality of photo holders thereby initially and successively obstructing displacement of the trailing face of the plurality of photo holders into the at least one opening, (2) as the drive element continues to rotate the drive mechanism, each photo holder being successively obstructed is further displaced until the spacing between the retaining tab and the pivot hinge of the photo holder being obstructed by the retaining tab exceeds the spacing between the pivot hinge of the photo holder being obstructed and the distal end of that photo holder, and (3) as the distal end of the respective photo holder escapes past the retaining tab, the respective biasing device immediately biases the photo holder approximately 180° whereat both the trailing face of that photo holder and the leading face of the next successive photo holder then being obstructed by the retaining tab are simultaneously visible through the at least one opening.

2. A motorized photo display as described in claim 1, wherein the plurality of orifices of the upper pivot ring and the plurality of orifices of the lower pivot ring are equidistantly-spaced apart along their respective upper or lower pivot ring.

3. A motorized photo display as described in claim 1, wherein the plurality of orifices of the upper pivot ring and the plurality of orifices of the lower pivot ring are equidistantly-spaced apart from the drive axis.

4. A motorized photo display as described in claim 1, wherein the at least one opening includes two openings spaced between the first and second wall portions on opposing sides of the wall portion, each opening having an opening edge with a retaining tab.

5. A motorized photo display as described in claim 1, wherein the drive mechanism includes:

(a) a lower gear fixedly secured to the drive shaft;

(b) an upper gear fixedly secured to the spindle; and (c) a coil spring biasing the upper gear downwardly wherein the upper gear drivingly engages the lower gear.

6. A motorized photo display as described in claim 5, wherein each of the upper and lower gears have gently-inclining gear portions spaced between steeply-declining gear portions.

7. A motorized photo display as described in claim 1, wherein at least one of the plurality of photo holders includes a partition separating the cavity into a leading cavity spaced between the leading face thereof and the partition, and a trailing cavity spaced between the trailing face thereof and the partition.

8. A motorized photo display as described in claim 1, further comprising a manually-operable mechanism spaced above the top portion and fixedly secured to the spindle.

9. A motorized photo display comprising:

(a) a base;

(b) a frame including:

(1) a bottom portion mounted on the base, (2) a wall portion mounted on the bottom portion, the bottom portion including a first wall portion and a second wall portion, the first and second wall portions defining two openings spaced between the first and second wall portions on opposing sides of the wall portion, each opening having an opening edge with a retaining tab, and (3) a top portion mounted on the wall portion and having a vertically-oriented orifice therethrough;

(c) a drive element mounted on the bottom portion, the drive element including a housing a motor with a drive shaft rotatable about a vertical-oriented drive axis, and a drive mechanism including:

(1) a lower gear fixedly secured to the drive shaft, (2) an upper gear fixedly secured to the spindle, (3) a coil spring biasing the upper gear downwardly against the lower gear wherein the upper gear drivingly engages the lower gear, and (4) each of the upper and lower gears have gently-inclining gear portions spaced between steeply-declining gear portions;

(d) a spool mechanism having a spindle with a vertically-oriented longitudinal axis, an upper spool portion having an upper pivot ring fixedly secured to and extending outwardly from an upper extremity thereof, a lower spool portion having a lower pivot ring fixedly secured to and extending outwardly from a lower extremity thereof; the upper pivot ring having a plurality of orifices equidistantly-spaced apart therealong; the lower pivot ring having a plurality of orifices equidistantly-spaced apart therealong wherein each orifice is vertically-aligned with and corresponds to an orifice of the plurality of orifices of the upper pivot ring; the spool mechanism being mounted on the drive mechanism wherein the longitudinal axis of the spindle is colinear with the drive axis and the spindle extends upwardly through the orifice of the top portion and the plurality of orifices of the upper and lower pivot rings are equidistantly-spaced apart from the drive axis;

(e) centering plates fixedly securing the upper and lower pivot rings about the spindle wherein the longitudinal axis of the spindle is colinear with the drive axis;

(f) a manually-operable mechanism spaced above the top portion and fixedly secured to the spindle;

(g) a plurality of photo holders, each having a pivot hinge pivotally mounted to a corresponding pair of vertically-aligned orifices of the plurality of orifices of the upper and lower pivot rings, each of the photo holders including a planar transparent leading face, a planar transparent trailing face, a distal end, a biasing device, and a cavity dimensioned to receive one or more photos to be operably visible through the leading face and one or more photos to be operably visible through the trailing face; and (h) a power source structured to provide electrical energy to the drive element; and (i) wherein, (1) as the drive element rotates the drive mechanism about the drive axis, each retaining tab successively extends into a path of the distal end of each of the photo holders of the plurality of photo holders thereby initially and successively obstructing displacement of the trailing face of the plurality of photo holders into the respective opening, (2) as the drive element continues to rotate the drive mechanism, each photo holder being successively obstructed is further displaced until the spacing between the retaining tab and the pivot hinge of the photo holder being obstructed by the retaining tab exceeds the spacing between the pivot hinge of the photo holder being obstructed and the distal end of that photo holder, and (3) as the distal end of the respective photo holder escapes past the respective retaining tab, the respective biasing device immediately biases the photo holder approximately 180° whereat both the trailing face of that photo holder and the leading face of the next successive photo holder then being obstructed by the retaining tab are simultaneously visible through the respective opening.

* * * * *